United States Patent [19]

Barbour

[11] 4,324,178

[45] Apr. 13, 1982

[54] IMPRINTING MACHINE WITH WHEEL SETTING RACK MECHANISM

[75] Inventor: William P. Barbour, Mount Prospect, Ill.

[73] Assignee: Security Imprinter Corporation, Walkersville, Md.

[21] Appl. No.: 146,099

[22] Filed: May 2, 1980

[51] Int. Cl.[3] ..... B41F 1/08

[52] U.S. Cl. ..... 101/45; 101/56; 101/269

[58] Field of Search ..... 101/45, 56, 269–274

[56] References Cited

U.S. PATENT DOCUMENTS

| | | | |
|---|---|---|---|
| 3,138,091 | 6/1964 | Maul | 101/45 |
| 3,322,062 | 5/1967 | Maul | 101/45 |
| 3,405,634 | 10/1968 | Maul et al. | 101/45 |
| 3,818,826 | 6/1974 | Geiger | 101/45 |
| 3,826,190 | 7/1974 | Zofchak | 101/45 |
| 3,881,411 | 5/1975 | Araki et al. | 101/45 |
| 3,946,665 | 3/1976 | Valentine et al. | 101/45 |
| 3,983,802 | 10/1976 | Thomson et al. | 101/45 |

*Primary Examiner*—Edward M. Coven

*Attorney, Agent, or Firm*—Maxon, Fenwick & Lawrence

[57] ABSTRACT

A variable data imprinting machine having an elongated flat printing bed section providing a document supporting surface and having a print wheel pack formed of closely adjacent peripherally notched print wheels, an imprinting carriage movable through advance and return strokes longitudinally along the document support surface and an elongated rack case section perpendicular to the printing bed section subjacent the wheel pack having a number-bearing rack control panel projecting therefrom and including a plurality of flexible band-like toothed racks coarse manually adjusted longitudinally in the rack case to rotatably index the print wheels to number-printing positions. The rack case includes serpentine elongated guide slot trackways sized to receive and guide the toothed racks for their longitudinal wheel-indexing movement. A pivoted centering blade is activated by carriage movement to fine adjust the racks as the carriage leaves parked position and interlock means are provided to latch the carriage at parked position following an imprinting cycle until one of the racks is readjusted.

32 Claims, 9 Drawing Figures

Fig-1
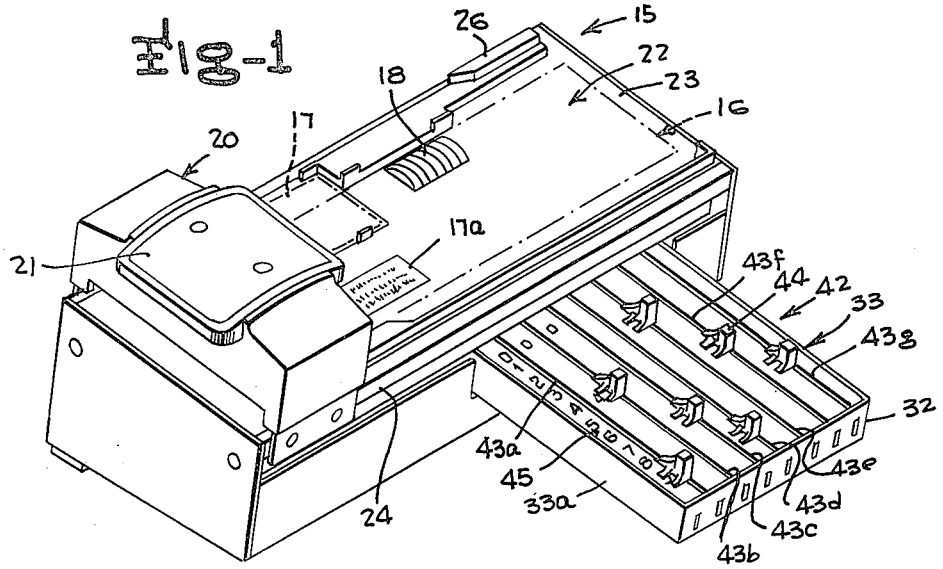
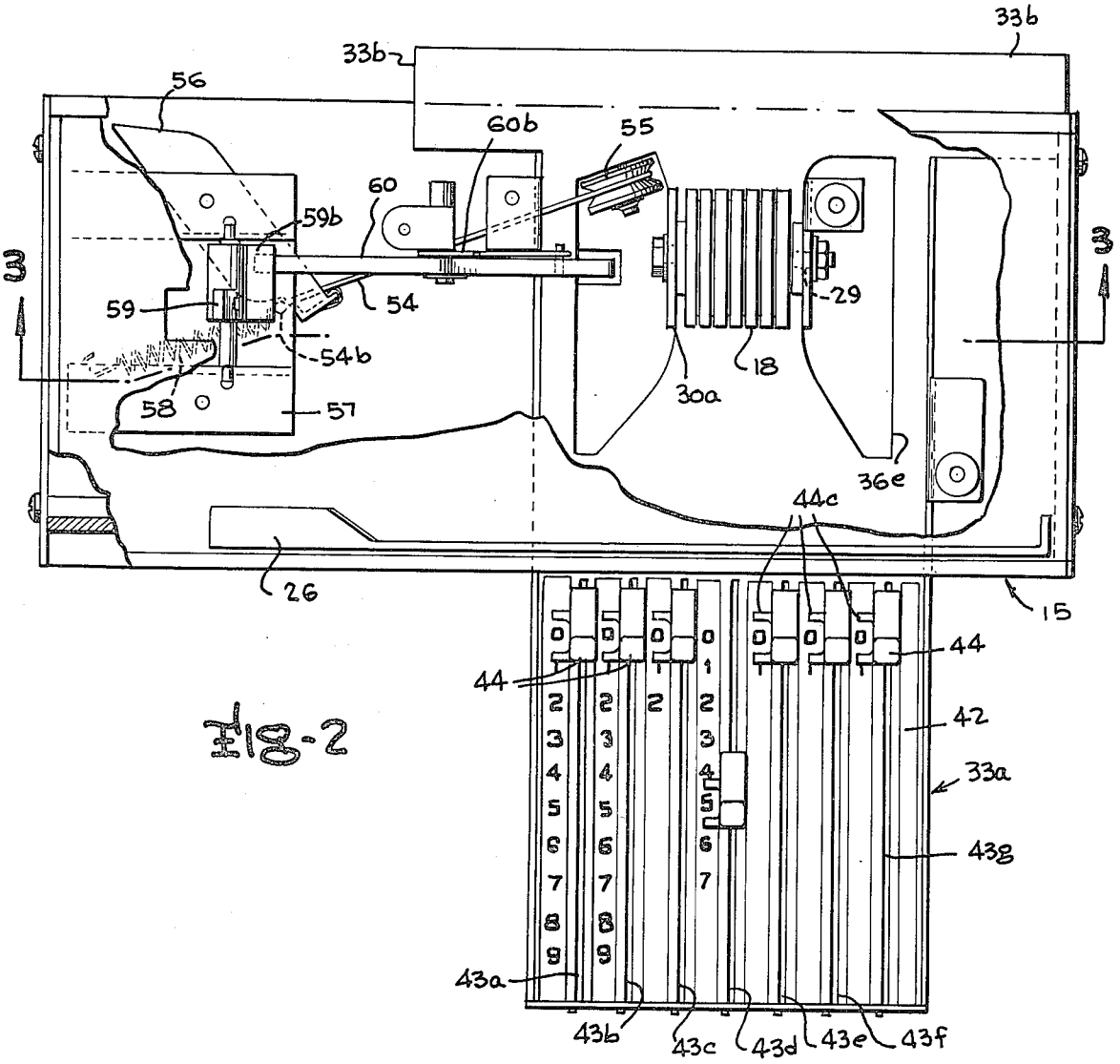
Fig-2

Fig-3
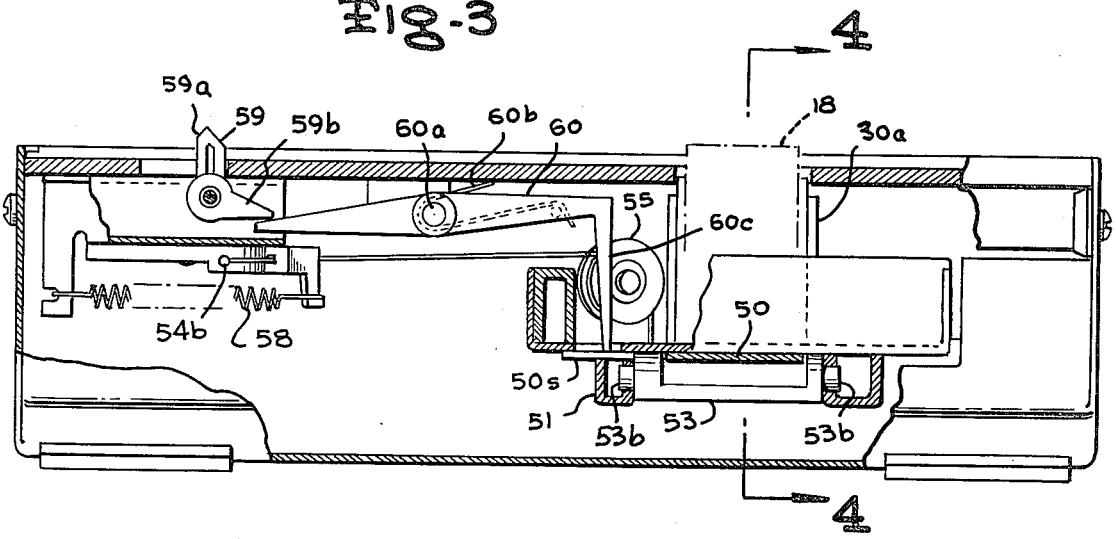
Fig-4
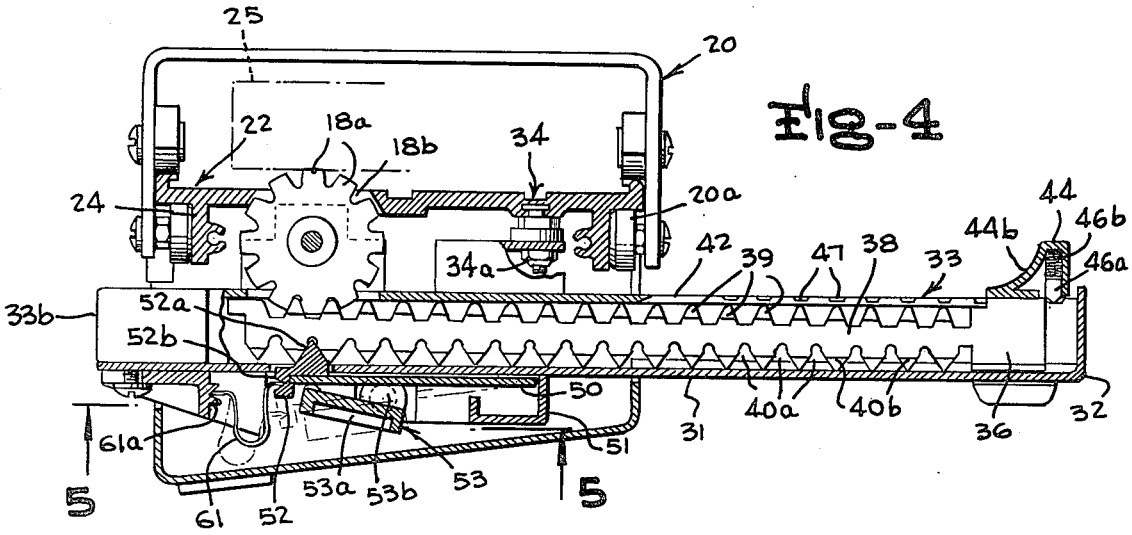
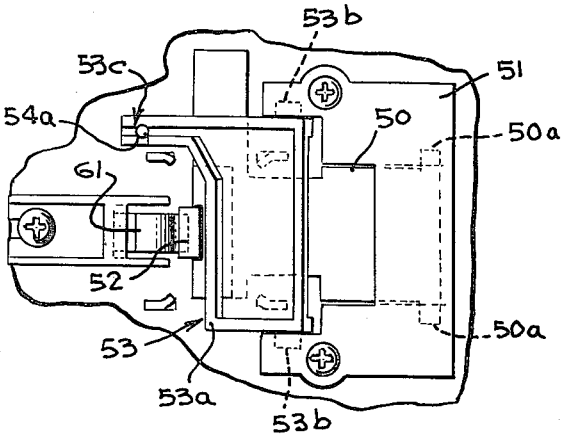
Fig-5

37a
37b
36

44
44a
44b 44
44b
44c
44a 36
36e
37a
37b
37c
37d
37e
37f
37g
7
7
41a
41b
41c
41c
44
44b
44c
44a
8
8
38g
39
39
40a
40b
40a
40b
46a
46b

IMPRINTING MACHINE WITH WHEEL SETTING RACK MECHANISM

BACKGROUND AND OBJECTS OF THE INVENTION

The present invention relates in general to manually operated imprinting machines, and more particularly to manually operated imprinters of the type using a plurality of printing wheels each of which may be selectively indexed so as to be able to present a variety of indicia to a document, usually formed of one or more sheets, placed on an imprinting bed over the printing wheels.

Imprinting machines wherein a plurality of printing wheels may be manually indexed to present a variety of indicia to a sheet or plural sheet document or sales ticket, concurrently with imprinting on the document or sales ticket certain information embossed on a credit card or the like, have come into wide use for recording sales information in the petroleum industry, for example at gasoline service stations, and to some extent in the bank sponsored credit industry. Such imprinting machines, which are frequently referred to as imprinters, have been utilized to transfer embossed information from a plastic card as well as data relating to the particular sales transaction, such as date, price, etc., on a document usually formed of a plurality of sheets forming a sales ticket, so that one of the sheets of the plural sheet document may be subsequently relied upon as the record of the transaction and processed for purposes of billing the customer. The documents that are commonly used to record such transactions usually consist of a plurality of sheets containing one or more carbons to provide several copies of the transaction. Use of a rolling platen has been resorted to for carrying out the printing operation by pressing the plural document sheet positioned on an imprinting bed against the printing wheels and the credit card to obtain clear impressions on each copy. An example of such a variable data imprinting machine is disclosed in my earlier U.S. Pat. No. 3,739,716 granted June 19, 1973.

In order to make variable data imprinting machines attractive to a wider variety of users, and thus achieve a considerably larger volume use of such devices, it is important to reduce the cost of production, without however reducing their mechanical effectiveness. Presently available variable amount imprinters wherein the printing wheels are driven by mechanical means carry a heavy cost penalty because of the steel rack system used to position the printing wheels. The construction in current use depends on precisely made steel racks, usually of stainless steel, which are held in precise proximity to the toothed portion of the print wheels by stampings, dye castings, steel shafts and the like. The racks are, of course, held in close proximity where they run under the closely spaced print wheels in driving relation to the toothed portion of the print wheels, but must be arranged in such a way to provide sufficient lateral spacing between the racks along a keyboard or control panel where an operator may grasp them without interference from the next adjacent rack terminus, usually a manipulating knob. Presently, this lateral spacing or "offsetting" of the racks in the keyboard or control panel zone relies on creating offset arms on the individual racks, which is quite expensive because of the extra forming operation and the metal scrap generated, or the spacing or offsetting may involve separate offsetting arms which may be attached to each rack by spot-welding or other mechanical means, either of which adds substantially to the cost of the item. Regardless of the means used to obtain this "offsetting" of the rack manipulated portions in the keyboard zone, a guidance and support system must be present to have the racks run smoothly, which usually takes the form of plastic molded blocks, wheels, runners and the like all of which add complexity and cost to the unit.

An object of the present invention therefore, is the provision of a novel variable data imprinting machine having a plurality of numbered amount wheels which are closely packed together and mechanically driven by a novel rack structure in a manner which permits drastic cost reduction and greatly simplifies the mechanism while retaining the dependability of earlier variable data imprinting machines and requires less space.

Another object of the present invention is the provisiion of a novel variable data imprinting machine involving a plurality of closely spaced or packed print wheels projecting through an imprinter bedplate for imprinting number or character information on plural sheet documents such as sales tickets or the like supported on the bed, along with imprinting credit card information thereon, wherein the print wheels are indexed to manually adjusted positions by molded plastic racks adjustable from a keyboard or control panel area and moving along serpentine paths through the print wheel zone.

Another object of the present invention is the provision of a novel variable data imprinting machine having a plurality of character bearing print wheels which are closely packed together and mechanically driven by a novel rack structure to position selected characters in upwardly facing printing position, and wherein a novel mechanism is provided to automatically accurately center the upwardly facing characters in the predetermined position during movement of a printing roller carriage from normal parked position through an imprinting stroke.

Yet another object of the present invention is the provision of a novel variable data imprinting machine as described in any of the three preceding paragraphs, wherein there is provided a novel interlock mechanism designed to maintain the printing roller carrier locked in parked position at the end of its return stroke after imprinting, until at least one of the racks for positioning the imprinting wheels has been readjusted, so that the carrier cannot be reciprocated through another printing stroke without readjustment of the racks.

Other objects, advantages and capabilities of the present invention will become apparent from the following detailed description, taken in conjunction with the accompanying drawings illustrating a preferred embodiment of the invention.

BRIEF DESCRIPTION OF THE FIGURES

FIG. 1 is a perspective view of a variable data imprinter constructed in accordance with the present invention;

FIG. 2 is a top plan view thereof, with parts broken away;

FIG. 3 is a fragmentary vertical section view along line 3—3 of FIG. 2;

FIG. 4 is a vertical section view transverse to the carriage movement axis along the print bed, taken along line 4—4 of FIG. 3;

FIG. 5 is a fragmentary section view showing the bell crank and associated structure, taken along line 5—5 of FIG. 4;

DETAILED DESCRIPTION OF A PREFERRED EMBODIMENT

Figures 6, 7, 8, 9:
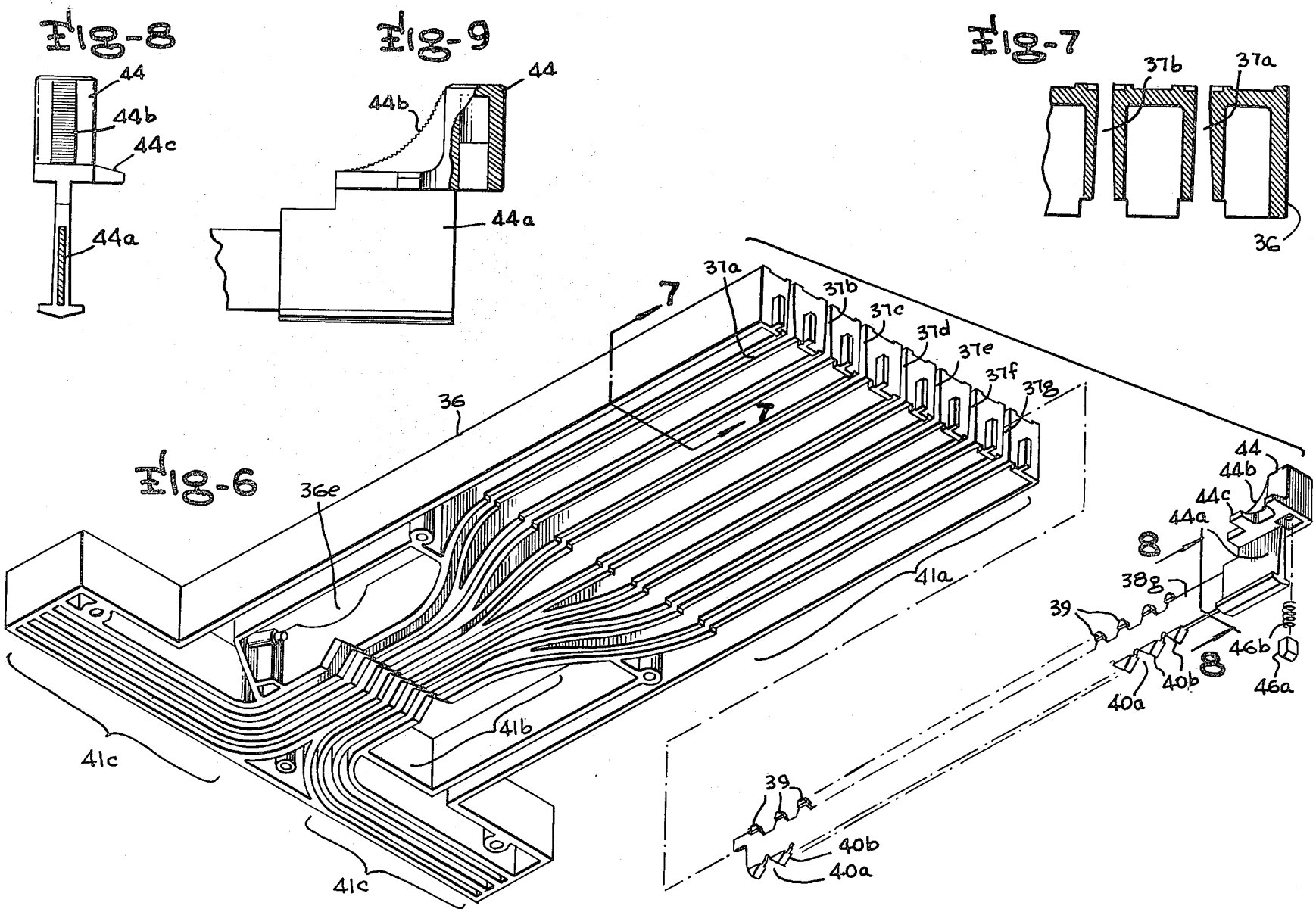
FIG. 6 is a perspective view of the rack guide-forming case and one of the flexible racks exploded therefrom.
FIG. 7 is a vertical section view, to enlarged scale, taken along line 7—7 of FIG. 6.
FIG. 8 is a vertical section view through one of the rack knobs, taken along line 8—8 of FIG. 6.
FIG. 9 is a side elevation of one of the rack knobs and adjacent portion of its associated rack.

Referring to the drawings, wherein like reference characters designate corresponding parts throughout the several figures, the imprinting machine of the present invention, indicated generally by the reference character 15, is designed, for example, for impressing indicia on a sales record document, indicated in broken lines at 16, such as a multiple sheet sales ticket or card-and-sheet preassembled sales record document with interleaved carbons providing sales transaction information such as amount of purchase, date of sales transaction, name and/or code number designation of the purchaser credit card holder, and perhaps the name and/or code number of the seller. The name and/or code number (or credit card number) of the purchaser are provided by embossings on the customer credit card, indicated by broken lines at 17, and the corresponding identification information regarding the seller, if the latter is to be imprinted on the document, are provided by embossings on a seller identifying plate 17*a* or may be preprinted on the sales document. The other sales data such as amount of purchases is provided by a bank of amount print wheels 18, and optional date print wheels (not shown), of conventional known construction may be included.

The imprinter 15 of the preferred example is of the variable data type currently in wide demand for imprinting sales information at gasoline service stations and the like, designed to permit the print wheels to be manually indexed for imprinting of numbers representing the amount of purchase on the sales ticket. To this end, the imprinter is of the roller platen type, constructed for example substantially in the manner disclosed in U.S. Pat. No. 3,538,848 or 3,954,056, so as to include a roller platen imprinter portion formed of a carriage 20 having a handle forming cover 21 shaped for comfort as a handgrip for use by the operator. The carriage 20 is adapted to be reciprocated through an advance stroke and a return stroke along the major portion of a printing bed 22. The printing bed 22 provides an upwardly facing flat bed surface 23 on which the customer credit card and the sales record document 16 are to be deposited, and the carriage 20 is designed to traverse the printing bed surface 23 through a rectilinear imprint stroke during its advance movement toward the right as viewed in FIG. 1 and then return to its rest position to the left as viewed in FIG. 1. Tracks are provided on each side of the printing bed 22, one of which is shown at 24, in which a pair of rollers 20*a* are located in each track and are journaled on depending side flanges of the carriage 20, all as disclosed in the above identified earlier patents. In the illustrated embodiment, stop shoulder members 24*a* of nylon, teflon or the like fixed on the carriage frame bear against the side rims of the printing bed above the rollers 20*a*.

A hard cylindrical printing roller, part of which is shown at 25 in FIG. 4, is rotatably mounted on a shaft supported for rotation in the carriage 20 below the cover 21 and is carried in a manner providing for movement of the roller within the carriage between a lower imprinting position during the advance or printing stroke of the carriage 20 and a raised nonimprinting or inactive position during the return stroke of the carriage. To this end, a pair of inclined ramp formations, one of which is shown at 26, are provided near opposite ends of the printing bed surface 23, in the preferred embodiment, to engage projecting end portions of the shaft for the printing rollers 25 and lift it to the raised position at the end of the advance or printing stroke, and return it to the lower position at the end of the return stroke, all as disclosed in earlier U.S. Pat. No. 3,954,056. The printing bed surface 23 in the illustrated embodiment is also provided with card locators to properly position the customer credit card 17 on the bed surface 23, and usually includes locators for the sales record document or ticket 16, in accordance with customary construction practices for printing machines.

The amount print wheels 18 in the illustrated embodiment are of conventional construction which in the illustrated embodiment form a bank of seven individual amount print wheels such as conventional 12 position print wheels having 12 circumferentially spaced imprint block portions 18*a* with raised type font on eleven of the block portions to imprint the characters 0 to 9 and a special symbol. These are separated from each other by twelve interposer notches 18*b* arranged to receive upwardly projecting teeth on adjusting rack members which are manually coarse adjusted and then are fine adjusted by an interposer blade member as later described for precisely positioning the print wheels to center the printing font at the correct position to be imprinted on the sales record document. The bank of seven amount print wheels 18 are mounted on a shaft 29 extending through spacers at opposite sides of the print wheel pack into openings in upwardly projecting mounting ears 30*a* of a pair of spaced assembly plates supported from the bottom wall 31 of a generally T-shaped box-like chassis 32 assembled with a T-shaped molded guide block member to form a rack case 33 having an elongated rectangular main portion 33*a* whose major axis extends transversely to the axis of the pack of print wheels 18 and the axis of movement of the carriage 20. The T-shaped rack case 33 houses the means for manually indexing or positioning the amount print wheels 18 and supports the pack of print wheels 18 (as well as the date print wheels if present). It is joined to the printing bed 22, in the preferred embodiment, by a three point bolt, nut and compression washer system, one of which is indicated at 34 whereby a mounting ear 35 extending upwardly from the bottom wall 31 of the chassis 32 is secured an adjustable distance below the printing bed surface 23 by adjustment of the nut 34*a* variably compressing the washer between the upper flange of the mounting ear 35 and a lock nut assembled on the bolt 34*b* abutting the bottom of the wall forming the surface 23. By variably adjusting the nuts corresponding to nut 34*a* of the three mounting bolt and nut and compressor washer assemblies, the amount of projection of the print wheels 18 above the surface of the printing bed surface 23 can be adjusted to present their topmost character to the imprinter platen or printing bed surface 23 for imprinting.

Instead of providing precisely made rigid metal racks, such as stainless steel racks, held in precise proximity to the toothed portion of the print wheels formed by the circumferentially spaced array of block portions 18*a* and interposer notches 18*b*, and using offset arms or bends in the individual racks to position them close together in the region where they engage the printing wheels and dispose them sufficiently far apart for noninterfering individual adjustment at the manually adjusted ends, a rack assembly structure of greatly reduced cost, while retaining appropriate dependability, has been devised for the present invention. In the preferred embodiment, the molded guide block member is in the form of a plastic tray-like body indicated at 36 which substantially fills the rectangular elongated portion of the T-shaped chassis 32 along the portion thereof underlying and projecting to the right of the printing bed 22 as viewed in FIG. 2, and contains a series of guideways 37*a*–37*g* which accept elongated moled plastic racks 38*a* to 38*g* having a plurality of teeth 39 along their upper edges conforming substantially to the shape of the interposer notches 18*b* in the amount print wheels 18. The racks 38*a–g* have a plurality of downwardly divergent V-shaped centering grooves 40*a* along their lower edges arranged in series relation with triangular teeth 40*b* between the respective centering grooves 40*a* for the purpose of achieving precise centering or alignment of the topmost character on the respective printing wheels, after coarse manual adjustment thereof, at the proper position to be imprinted on the sales record document when the carriage is reciprocated to its advance and return strokes.

The rack guideways 37*a*–37*g* extend along serpentine paths as illustrated in FIG. 6, from a series of parallel rectilinear zones 41*a* in the region of the slide knob control panel 42 of the imprinter, and curve toward each other to a closely spaced group of parallel path sections 41*b* underlying and aligned vertically with the seven amount print wheels 18, and then split and curve outwardly along oppositely directed path segments 41*c* extending toward opposite ends of the cross-stroke or cap portion 36*b* of the T-shaped body 36. In a preferred embodiment, the plastic racks 38*a–g* are made of a flexible material such as nylon ZYTEL ST 801, made by Du Pont, which is formed so as to be thicker at the crests of the upwardly extending teeth 39 to insure good engagement with the interposer notches 18*b* of the amount print wheels 18 and still allow a high degree of flexibility so that the racks can follow the serpentine guideways with a minimum of resistance. The offset created by the location and form of the serpentine racks 38*a–g* and guideways 37*a–g* achieves the same goal as the much more costly and complicated steel rack counterpart as previously produced.

The number-bearing slide knob control panel 42 extending to the right of the imprinter printing bed 22 in FIG. 2 includes seven elongated slots 43*a* to 43*g* aligned vertically with the portions of the straight section 41*a* the guideways 37*a*–37*g* beneath the control panel 42, through which extend connector portions 44*a* of knob members 44 which are fixed to the adjacent end portion of the racks 38*a–g*, as by thermally fusing the knob connector portions 44*a* to the racks. The upwardly extending knob members 44 rise above the plane of the control panel 42 and include serrated or knurled concave portions 44*b* to facilitate grasping and movement of the knobs and their associated racks. Numbers, for example on decal strips 45, are disposed on the control panel 42 alongside each of the slots 43*a–g*, and in the illustrated embodiment the knobs 44 have laterally extending flange portions 44*c* overlying the upper surface of the panel 42 and defining a sight opening therebetween through which the numbers may be viewed, to thereby indicate the appropriate positions to which the knobs should be adjusted to set the amount print wheels 18 to imprint the corresponding number on the sales record document. Detenting of the knobs is provided by a detent plunger 46*a*, having a wedge shaped lower end in the illustrated embodiment, movable vertically in a cavity in the knob 44 and biased downardly by a spring 46*b*, to interfit in upwardly facing notches indicated at 47 immediately adjacent the slots 43*a–g* in the panel 42.

It is desirable that the imprinter machine include a mechanism for accurately centering the troughs between the upper rack teeth 39 of the racks 26 in vertical alignment with the center axis of the amount print wheel shaft 29 during an early part of the advance or printing stroke of the carriage 20 or at least before the printing roller reaches the zone occupied by the amount print wheels, to insure proper registration of the upwardly facing characters on the print wheels with the imprinting area of the sales record document. This is because sight adjustment of the knobs 44 to the desired position alongside the numbers on the number strips 45, even with the aid of the spring detenting means, would not insure registration of the amount wheel characters with the desired precision. Interrelated with this mechanism is an interlock mechanism designed to maintain the carrier 20 locked in parked position at the end of the return stroke after imprinting until a rack has been readjusted, so that the carrier cannot be reciprocated through another printing and return stroke without readjustment of the knobs and racks.

The mechanism for effecting the centering of the amount printing wheels 18 and the interlocking of the carrier includes a centering blade carrier plate 50 having integral pivot ears 50*a* adjacent one transverse edge of the plate 50 fitted into recesses in a fixed centering blade keeper member 51 fixed by screws or the like to the underside of the bottom plate of the chassis 32. The centering blade carrier plate 50 has an upwardly extending centering blade member 52, which may be molded of plastic, fixed thereon providing an upwardly projecting triangular or wedge-shaped blade formation 52*a* corresponding to the downwardly diverging V-shaped centering grooves 40*a* between the lower teeth 40*b* of the rack 40 to interfit into one of the grooves 40*a* of each rack after they have been adjusted to desired number indicating positions and movement of the carrier 20 has commenced. The blade carrier plate 50 and blade member 52 normally occupy a lower position, indicated in broken lines in FIG. 4, resting against the arm 53*a* of bell crank member 53, which has trunnions or pivot stub shaft portions 53*b* also extending into and pivotally supported by appropriately shaped recesses in the blade keeper member 51. The arm 53*a* of the bell crank 53 has a free-edge portion underlying the part of the carrier plate 50 immediately adjacent the blade member 52 which bears against the underside of the carrier plate and raises the plate 50 to the upper rack centering position shown in solid lines in FIG. 4, when the bell crank 53 is pivoted to its solid line raised position. An overcenter torsion spring 61 has one end fitted in a V-notch 52*b* in blade member 52 and its other end in a V-notch 61*a* of the keeper member 51 to resiliently restrain the blade carrier plate 50 in raised or lowered position. The bell crank includes an extension 53*c* projecting from the arm 53*a* along one side edge thereof a greater distance from the pivot axis of the bell crank to receive the end portion of a cable 54 anchored, for example, by a cable stop ball or clamp 54*a*.

The cable 54 extends from the extension or projection 53*c* of the bell crank 53 upwardly over the cable pulley 55 journaled on a stub projecting into the hollow well 36*e* of the plastic tray-like body 36 toward the parked or normal end position of the carrier, and extends to a location under the parked location for the carrier where it passes through an opening adjacent one end of the cable control lever 56 pivoted for movement about a vertical axis beneath a supporting bracket 57. The end of the cable 54 passing through the opening in the cable control lever 56 has a ball stop 54*b* thereon which, when the lever 56 is in the position illustrated in FIG. 2, which it assumes when the carrier 20 occupies the parked position, is spaced a short distance along the cable 54 from the point where the cable passes through the opening in the lever 56 to provide a lost motion coupling. The cable control lever 56 is resiliently biased to a retracted position displacing the lever 56 clockwise from the position illustrated in FIG. 2 by a coil spring 58 when the carrier 20 is displaced from its parked position.

A carrier locking pawl 59 of generally bell crank configuration having an upwardly projecting locking finger 59*a* and a horizontally projecting finger 59*b* is pivoted about a horizontal axis in openings in the supporting bracket 57 and, when occupying the locking position shown in FIG. 3, extends the upwardly projecting finger 59*a* into a notch in the carrier 20 when the carrier is located at the parked position to lock the carrier against advancement. The locking pawl 59 is normally retained in this position by a sensing lever 60 biased about a pivot 60*a* by a torsion spring 60*b*, having one end of the lever engaging the arm 59*b* of the carrier locking pawl 59 and having a downwardly projecting finger 60*c* at its opposite end projecting downwardly to abut the laterally extending shelf formation 50*s* of the centering blade carrier plate 50. The arrangement is such that when the centering blade carrier plate 50 is in the up or raised position, the depending finger 60*c* of the sensing lever 60 is raised positioning the sensing lever so that the carrier locking pawl 59 occupies the solid line position shown in FIG. 3, to which it is gravitionally biased by the weight of the heavier arm 59*b* thereof, disposing the pawl in carrier locking position. When, however, any of the racks 38*a–g* are repositioned by movement of their associated knob 44, the centering blade carrier plate 50 is camming downwardly by the interaction of the inclined walls of the V-shaped grooves 40*a* of the racks on the inclined walls of the wedge-shaped formation 52*a* of centering blade member 52, whereby the spring 60*b* rotates the sensing lever 60 clockwise from the solid line position shown in FIG. 3, thereby elevating its opposite end 60*d* in contact with the pawl 59 and thus rotating the pawl 59 counterclockwise to an unlocking position withdrawing the tip of the pawl 59*a* to a location substantially flush with the printing bed surface 23.

It will be appreciated that the cable control lever 56 will be returned in a counterclockwise direction as viewed in FIG. 2, against the bias of its associated spring 58, when the carrier 20 is completing its return stroke and reaches the parked location because of the carrier's engagement with the cable control lever 56. This allows the end of the cable associated with the stop 54*b* to return toward the print wheel pack and allows the bell crank 53 to drop under gravitational bias to its lower position wherein it no longer sustains the blade carrier plate 50 at its raised position. However, the blade carrier plate 50 remains at this raised position by reason of the torsion spring 61. This torsion spring 61 acts as an overcenter spring, such that it is positioned to hold the blade carrier plate 50 in its raised position after it is lifted to this position by raising of the bell crank 53, until such time as one of the racks 40 is readjusted causing the centering blade member 52 to be cammed downwardly out of the V-groove 40*a* of the rack which it occupied, which action shifts the spring 61 overcenter to a lower position resiliently biasing the plate 50 at its lower position shown in broken lines in FIG. 4, until it is again elevated by the bell crank 53.

The interaction of these components is such that, when the carrier 20 is in its parked position after an imprinting and return stroke, but no rack 40 has been moved or readjusted from the position to which it was adjusted for the preceeding operating cycle, the carriage 20 is locked by the pawl 59 which is gravity or spring biased to the locking position of FIG. 3 with the heavier arm 59*b* engaging the sensing lever 60. The lever 60 remains in its FIG. 3 position since the centering blade carrier plate 50 is held up by the torsion spring 61. When one of the racks 40 is readjusted, the centering blade member 52 is cammed downwardly by the inclined wall of the rack V-groove 40*a* in which it was seated, causing the blade carrier plate 50 to descend to its lower or broken line position, and thereby allowing the sensing lever 60 to be rotated by its spring 60*b* to swing the pawl 59 to the carriage release position.

When the carriage 20 is moved through the initial portion of its print stroke, the cable control lever 56, which was held in its cocked or displaced position by the carriage 20, is released and swings under the force of the spring 58, rotating the lever in a clockwise direction as viewed in FIG. 2, to retract the end of the lever 56 into engagement with the ball stop 54*b* on the cable pulling it to a position causing the cable to lift the bell crank 53 to its raised position. This raising of the bell crank 53 in turn lifts the centering blade carrier plate 50 to its raised position and inserts the centering blade formation 52*a* of the blade member 52 snugly into the downwardly facing V-shaped centering grooves 40*a* of the racks 38*a–*38*g* most nearly aligned therewith to center the racks and thus appropriately center the amount print wheels 18. During this raising of the centering blade carrier plate 50 and centering blade member 52, the torsion spring 61 shifts overcenter from the lower position to the upper position to resiliently retain the carrier plate 50 in its raised position, where it stays until carriage 20 returns to the parked position. When the carriage 20 returns to its parked position, the cable control lever 56 is again displaced by the carriage 20 against the action of its spring 58 to assume its cocked or displaced position, allowing the cable 54 to move in a direction causing the bell crank 53 to descend to its lower position, although the centering blade member 52 and its carrier plate 50 remain in the up or raised position due to the torsion spring 61. Then, when one of the racks 38*a–*38*g* is readjusted, the camming action of the inclined walls of the rack centering groove 40*a* in which the centering blade has been seated displaces the centering blade carrier plate 50 downwardly to its lower position whereupon the torsion spring 61 resiliently locates the carrier plate 50 at this lower position until it is elevated again by raising of the bell crank 53.

I claim:

1. A variable data imprinting machine comprising an elongated housing defining a substantially rectangular elongated flat printing bed providing a document supporting surface and having first and second sides, a print wheel pack formed of rotatable, coaxial side-by-side closely adjacent print wheels each having circumferentially spaced raised-number-bearing imprint block formations separated by notches about their peripheries for imparting impressions to a document on the document supporting surface, an imprinting carriage movable through advance and return strokes longitudinally along the document support surface having a roller platen for transfer of imprinted characters to the document during one of said strokes, an elongated rack case perpendicularly transvering said housing subjacent the wheel pack having a number-bearing rack control panel portion projecting beyond the first housing side, a plurality of elongated flexible slide straps of transversely thin vertically elongated cross-section having opposite ends located near opposite longitudinal ends of the rack case and forming toothed racks slidable longitudinally in said rack case, said racks having teeth along their upper edges engaging the peripheral notches of the respective print wheels to rotatably index the print wheels to selected number-printing positions, the rack case having means forming plural elongated guide slot trackways therein having paired confronting sides spaced to correspond to the width of the straps to receive and guide the toothed racks therein for their longitudinal wheel-indexing movement, said guide slot trackways defining serpentine paths in top plan providing intermediate laterally closely adjacent path segments underlying and vertically aligned with the respective print wheels directed longitudinally of the case and communicating transition segments curving in lateral diverging relation therefrom to join more widely spaced parallel trackway path segments also directed longitudinally of the case and underlying the control panel portion.

2. A variable data imprinting machine as defined in claim 1, wherein said guide slot trackways include second end portions extending in outwardly oppositely curving path segments adjacent the second side of the housing for receiving the flexible track portions extending beyond the wheel pack toward the second side.

3. A variable data imprinting machine as defined in claim 2, wherein said racks have downwardly divergent substantially V-shaped centering grooves in predetermined positional relationship to said teeth, and centering means activated by movement of said carriage during a pre-imprinting part of its advance stroke and including a centering blade member insertable into said centering grooves of each rack for precisely aligning the print wheels to insure proper fine adjustment registration of the imprinting numbers at the printing positions.

4. A variable data imprinting machine as defined in claim 3, wherein said centering means includes a wedge-like blade forming said blade member on a pivoted support movable between an upper position inserted in said grooves and a lower inactive position withdrawn from the grooves, a control lever in the path of movement of the carriage to assume active and release positions responsive to carriage movement, and blade lifting means coupled to the control lever for raising said blade member into fine adjustment centering insertion into the grooves when the control lever moves to said active position upon movement of the carriage through said pre-imprinting part of its advance stroke and for releasing said blade member to return to its inactive position when the carriage nears completion of its return stroke.

5. A variable data imprinting machine as defined in claim 4, wherein said blade lifting means is a carrier plate pivoted for movement about an axis near and parallel to the pivot axis of the blade member and connected to said control lever to swing upwardly against the blade member for inserting the latter into the centering grooves when the control lever moves to said active position and to swing downwardly to a release position when the control lever moves to its release position.

6. A variable data imprinting machine as defined in claim 4, wherein said blade lifting means is a carrier plate pivoted for movement about an axis near and parallel to the pivot axis of the blade member and connected to said control lever to swing upwardly against the blade member for inserting the latter into the centering grooves when the control lever moves to said active position and to swing downwardly to a release position when the control lever moves to its release position, said blade member and centering grooves being shaped to cause the blade member to be cammed downwardly by manual readjustment of any of said racks from the fine adjustment positions produced by the last-preceding lifting of the blade member, and overcenter spring means for resiliently restraining the blade member in raised centering position inserted into the grooves following lowering of the carrier plate to its release position until one of the racks is readjusted.

7. A variable data imprinting machine as defined in claim 4, including a latch member carried by the housing movable to latching and unlatching conditions respectively relative to said carriage to latch the carriage when the carriage occupies a parked position at the end of the return stroke, and latch control means responsive to means displaced by movement of the carriage and movement of any of the racks for locating the latch member in its latching condition following initiation of advance stroke movement of the carriage to latch the carriage upon reaching its parked position and for moving the latch member to unlatching condition upon lowering of the blade member responsive to readjustment of any rack from its fine adjusted previous setting.

8. A variable data imprinting machine as defined in claim 3, including a latch member carried by the housing movable to latching and unlatching conditions respectively relative to said carriage to latch the carriage when the carriage occupies a parked position at the end of the return stroke, and latch control means responsive to means displaced by movement of the carriage and movement of any of the racks for locating the latch member in its latching condition following initiation of advance stroke movement of the carriage to latch the carriage upon reaching its parked position and for moving the latch member to unlatching condition upon lowering of the blade member responsive to readjustment of any rack from its fine adjusted previous setting.

9. A variable data imprinting machine as defined in claim 2, including a latch member carried by the housing movable to latching and unlatching conditions respectively relative to said carriage to latch the carriage when the carriage occupies a parked position at the end of its return stroke, and latch control means responsive to the position of said blade member for locating the latch member in its latching condition following initiation of advance stroke movement of the carriage to latch the carriage upon reaching its parking position and for moving the latch member to unlatching condition responsive to readjustment of any rack from its fine adjusted previous setting.

10. A variable data imprinting machine as defined in claim 2, wherein the notch engaging teeth of said racks form a set of upper teeth along upper edges of the racks and said racks include a set of lower teeth along lower edges of the racks having downwardly divergent substantially V-shaped centering grooves between the lower teeth in predetermined positional relationship to the upper teeth, and centering means activated by movement of said carriage during a pre-imprinting part of its advance stroke and including a centering blade member insertable into said centering grooves of each rack for precisely aligning the print wheels to insure proper fine adjustment registration of the imprinting numbers at the printing positions.

11. A variable data imprinting machine as defined in claim 1, wherein said control panel portion includes an upwardly facing top panel having rectilinear parallel slots extending substantially the length thereof vertically aligned with and corresponding in number to the path segments of said first end portions of said guide slot trackways, and said flexible band-like toothed racks having knobs respectively connected to the racks through said slots and disposed at accessible positions overlying the control panel for manual adjustment thereof to number setting positions, said slots being disposed sufficiently wide apart for non-interfering manipulation of the respective knobs.

12. A variable data imprinting machine as defined in claim 11, wherein said panel includes numbers adjacent the control panel slots signifying the positions for the knobs to achieve coarse adjustment location of corresponding print wheel numbers at the printing positions, the panel having detent notches adjoining said slots at the number setting positions of said knobs, and the knobs each having detent members engageable in said detent notches.

13. A variable data imprinting machine as defined in claim 12, including a latch member carried by the housing movable to latching and unlatching conditions respectively relative to said carriage to latch the carriage when the carriage occupies a parked position at the end of its return stroke, and latch control means responsive to the position of said blade member for locating the latch member in its latching condition following initiation of advance stroke movement of the carriage to latch the carriage upon reaching its parking position and for moving the latch member to unlatching condition responsive to readjustment of any rack from its fine adjusted previous setting.

14. A variable data imprinting machine as defined in claim 12, wherein said racks have downwardly divergent substantially V-shaped centering grooves in predetermined positional relationship to said teeth, and centering means activated by movement of said carriage during a pre-imprinting part of its advance stroke and including a centering blade member insertable into said centering grooves of each rack for precisely aligning the print wheels to insure proper fine adjustment registration of the imprinting numbers at the printing positions.

15. A variable data imprinting machine as defined in claim 14, wherein said centering means includes a wedge-like blade forming said blade member on a pivoted support movable between an upper position inserted in said grooves and a lower inactive position withdrawn from the grooves, a control lever in the path of movement of the carriage to assume active and release positions responsive to carriage movement, and blade lifting means coupled to the control lever for raising said blade member into fine adjustment centering insertion into the grooves when the control lever moves to said active position upon movement of the carriage through said pre-imprinting part of its advance stroke and for releasing said blade member to return to its inactive position when the carriage nears completion of its return stroke.

16. A variable data imprinting machine as defined in claim 15, wherein said blade lifting means is a carrier plate pivoted for movement about an axis near and parallel to the pivot axis of the blade member and connected to said control lever to swing upwardly against the blade member for inserting the latter into the centering grooves when the control lever moves to said active position and to swing downwardly to a release position when the control lever moves to its release position.

17. A variable data imprinting machine as defined in claim 15, wherein said blade lifting means is a carrier plate pivoted for movement about an axis near and parallel to the pivot axis of the blade member and connected to said control lever to swing upwardly against the blade member for inserting the latter into the centering grooves when the control lever moves to said active position and to swing downwardly to a release position when the control lever moves to its release position, said blade member and centering grooves being shaped to cause the blade member to be cammed downwardly by manual readjustment of any of said racks from the fine adjustment positions produced by the last-preceding lifting of the blade member, and overcenter spring means for resiliently restraining the blade member in raised centering position inserted into the grooves following lowering of the carrier plate to its release position until one of the racks is readjusted.

18. A variable data imprinting machine as defined in claim 17, including a latch member carried by the housing movable to latching and unlatching conditions respectively relative to said carriage to latch the carriage when the carriage occupies a parked position at the end of the return stroke, and latch control means responsive to means displaced by movement of the carriage and movement of any of the racks for locating the latch member in its latching condition following initiation of advance stroke movement of the carriage to latch the carriage upon reaching its parking position and for moving the latch member to unlatching condition upon lowering of the blade member responsive to readjustment of any rack from its fine adjusted previous setting.

19. A variable data imprinting machine as defined in claim 14, including a latch member carried by the housing movable to latching and unlatching conditions respectively relative to said carriage to latch the carriage when the carriage occupies a parked position at the end of the return stroke, and latch control means responsive to means displaced by movement of the carriage and movement of any of the racks for locating the latch member in its latching condition following initiation of advance stroke movement of the carriage to latch the carriage upon reaching its parking position and for moving the latch member to unlatching condition upon lowering of the blade member responsive to readjustment of any rack from its fine adjusted previous setting.

20. A variable data imprinting machine as defined in claim 12, wherein the notch engaging teeth of said racks form a set of upper teeth along upper edges of the racks and said racks include a set of lower teeth along lower edges of the racks having downwardly divergent substantially V-shaped centering grooves between the lower teeth in predetermined positional relationship to the upper teeth, and centering means activated by movement of said carriage during a pre-imprinting part of its advance stroke and including a centering blade member insertable into said centering grooves of each rack for precisely aligning the print wheels to insure proper fine adjustment registration of the imprinting numbers at the printing positions.

21. A variable data imprinting machine as defined in claim 20, wherein said centering means includes a control lever in the path of movement of the carriage to assume active and release positions responsive to carriage movement, and blade lifting means coupled to the control lever for raising said blade into fine adjustment centering insertion into the grooves when the control lever moves to said active position upon movement of the carriage through said pre-imprinting part of its advance stroke and for releasing said blade to return to its inactive position when the carriage nears completion of its return stroke.

22. A variable data imprinting machine as defined in claim 1, wherein said racks have downwardly divergent substantially V-shaped centering grooves in predetermined positional relationship to said teeth, and centering means activated by movement of said carriage during a pre-imprinting part of its advance stroke and including a centering blade member insertable into said centering grooves of each rack for precisely aligning the print wheels to insure proper fine adjustment registration of the imprinting numbers at the printing positions.

23. A variable data imprinting machine as defined in claim 22, wherein said centering means includes a wedge-like blade forming said blade member on a pivoted support movable between an upper position inserted in said grooves and a lower inactive position withdrawn from the grooves, a control lever in the path of movement of the carriage to assume active and release positions responsive to carriage movement, and blade lifting means coupled to the control lever for raising said blade member into fine adjustment centering insertion into the grooves when the control lever moves to said active position upon movement of the carriage through said pre-imprinting part of its advance stroke and for releasing said blade member to return to its inactive position when the carriage nears completion of its return stroke.

24. A variable data imprinting machine as defined in claim 23, wherein said blade lifting means is a carrier plate pivoted for movement about an axis near and parallel to the pivot axis of the blade member and connected to said control lever to swing upwardly against the blade member for inserting the latter into the centering grooves when the control lever moves to said active position and to swing downwardly to a release position when the control lever moves to its release position.

25. A variable data imprinting machine as defined in claim 23, including a latch member carried by the housing movable to latching and unlatching conditions respectively relative to said carriage to latch the carriage when the carriage occupies a parked position at the end of the return stroke, and latch control means responsive to means displaced by movement of the carriage and movement of any of the racks for locating the latch member in its latching condition following initition of advance stroke movement of the carriage to latch the carriage upon reaching its parking position and for moving the latch member to unlatching condition upon lowering of the blade member responsive to readjustment of any rack from its fine adjusted previous setting.

26. A variable data imprinting machine as defined in claim 22, wherein said centering means includes a control lever in the path of movement of the carriage to assume active and release positions responsive to carriage movement, and blade lifting means coupled to the control lever for raising said blade into fine adjustment centering insertion into the grooves when the control lever moves to said active position upon movement of the carriage through said pre-imprinting part of its advance stroke and for releasing said blade to return to its inactive position when the carriage nears completion of its return stroke.

27. A variable data imprinting machine as defined in claim 22, including a latch member carried by the housing movable to latching and unlatching conditions respectively relative to said carriage to latch the carriage when the carriage occupies a parked position at the end of the return stroke, and latch control means responsive to means displaced by movement of the carriage and movement of any of the racks for locating the latch member in its latching condition following initiation of advance stroke movement of the carriage to latch the carriage upon reaching its parking position and for moving the latch member to unlatching condition upon lowering of the blade member responsive to readjustment of any rack from its fine adjusted previous setting.

28. A variable data imprinting machine as defined in claim 1, wherein the notch engaging teeth of said racks form a set of upper teeth along upper edges of the racks and said racks include a set of lower teeth along lower edges of the racks having downwardly divergent substantially V-shaped centering grooves between the lower teeth in predetermined positional relationship to the upper teeth, and centering means activated by movement of said carriage during a pre-imprinting part of its advance stroke and including a centering blade member insertable into said centering grooves of each rack for precisely aligning the print wheels to insure proper fine adjustment registration of the imprinting numbers at the printing positions.

29. A variable data imprinting machine as defined in claim 28, wherein said centering means includes a control lever in the path of movement of the carriage to assume active and release positions responsive to carriage movement, and blade lifting means coupled to the control lever for raising said blade into fine adjustment centering insertion into the grooves when the control lever moves to said active position upon movement of the carriage through said pre-imprinting part of its advance stroke and for releasing said blade to return to its inactive position when the carriage nears completion of its return stroke.

30. A variable data imprinting machine as defined in claim 1, including a latch member carried by the housing movable to latching and unlatching conditions respectively relative to said carriage to latch the carriage when the carriage occupies a parked position at the end of its return stroke, and latch control means responsive to the position of said blade member for locating the latch member in its latching condition following initiation of advance stroke movement of the carriage to latch the carriage upon reaching its parking position and for moving the latch member to unlatching condition responsive to readjustment of any rack from its fine adjusted previous setting.

31. A variable data imprinting machine comprising an elongated housing defining a substantially rectangular elongated flat printing bed providing a document supporting surface and having first and second sides, a print wheel pack formed of rotatable, coaxial side-by-side closely adjacent print wheels each having circumferentially spaced raised-number-bearing imprint block formations separated by notches about their peripheries for imparting impressions to a document on the document supporting surface, an imprinting carriage movable through advance and return strokes longitudinally along the document support surface having a roller platen for transfer of imprinted characters to the document during one of said strokes, an elongated rack case perpendicularly traversing said housing subjacent the wheel pack having a number-bearing rack control panel portion projecting beyond the first housing side, a plurality of flexible band-like toothed racks slidable longitudinally in said rack case with teeth of each of the racks engaging notches of the respective print wheels to rotatably index the print wheels to selected number-printing positions, the rack case having means forming plural elongated guide slot trackways therein sized to receive and guide the toothed racks therein for their longitudinal wheel-indexing movement, said guide slot trackways defining serpentine paths in top plan providing intermediate laterally closely adjacent path segments underlying and vertically aligned with the respective print wheels and first end portions cur therefrom laterally to form more widely spaced parallel trackway path segments underlying the control panel portion, centering means activated by movement of said carriage during a pre-imprinting part of its advance stroke and including a centering blade member insertible into centering grooves on each rack for precisely aligning the print wheels to ensure proper fine adjustment registration of the imprinting numbers at the printing positions, said centering means including a control lever in the path of movement of the carriage to assume active and release positions responsive to carriage movement, blade lifting means coupled to the control lever for raising said blade member into fine adjustment centering insertion into the grooves when the control lever moves to said active position upon movement of the carriage through said pre-imprinting part of its advance stroke and for releasing said blade member to return to its inactive position when the carriage nears completion of its return stroke, wherein said blade lifting means is a carrier plate pivoted for movement about an axis near and parallel to the pivot axis of the blade member and connected to said control lever to swing upwardly against the blade member for inserting the latter into the centering grooves when the control lever moves to said active position and to swing downwardly to a release position when the control lever moves to its release position, said blade member and centering grooves being shaped to cause the blade member to be cammed downwardly by manual readjustment of any of said racks from the fine adjustment positions produced by the last-preceding lifting of the blade member, and overcenter spring means for resiliently restraining the blade member in raised centering position inserted into the grooves following lowering of the carrier plate to its release position until one of the racks is readjusted.

32. A variable data imprinting machine as defined in claim 31, including a latch member carried by the housing movable to latching and unlatching conditions respectively relative to said carriage to latch the carriage when the carriage occupies a parked position at the end of the return stroke, and latch control means responsive to means displaced by movement of the carriage and movement of any of the racks for locating the latch member in its latching condition following initiation of advance stroke movement of the carriage to latch the carriage upon reaching its parking position and for moving the latch member to unlatching condition upon lowering of the blade member responsive to readjustment of any rack from its fine adjusted previous setting.

* * * * *